United States Patent [19]

Guida

[11] 4,334,485

[45] Jun. 15, 1982

[54] METHOD FOR GENERATING HEAT ENERGY BY INTERMITTENT SMOKE CHARGE COMBUSTION

[76] Inventor: Frank C. Guida, 50 Allen St., Walpole, Mass. 02081

[21] Appl. No.: 255,805

[22] Filed: Apr. 20, 1981

Related U.S. Application Data

[63] Continuation of Ser. No. 61,945, Jul. 30, 1979, abandoned.

[51] Int. Cl.[3] ..... F23D 1/00

[52] U.S. Cl. ..... 110/347; 122/24; 123/23; 431/1

[58] Field of Search ..... 431/1; 122/15, 24; 123/23; 110/102, 104 B, 106, 347; 60/39.46 S

[56] References Cited

U.S. PATENT DOCUMENTS

| | | | |
|---|---|---|---|
| 1,897,819 | 2/1933 | Pawlikowski | 123/23 |
| 2,439,748 | 4/1948 | Nettel | 123/23 |
| 2,634,804 | 4/1953 | Erickson | 431/1 |
| 2,861,423 | 11/1958 | Verie et al. | 60/39.46 S |
| 3,918,879 | 11/1975 | Arvidsson | 431/1 |

*Primary Examiner*—Samuel Scott
*Assistant Examiner*—Lee E. Barrett
*Attorney, Agent, or Firm*—Morse, Altman, Oates & Dacey

[57] ABSTRACT

Devices and processes are provided for intermittently exploding smoke charges in such a way as to extract thermal energy cheaply and efficiently for various applications.

6 Claims, 1 Drawing Figure

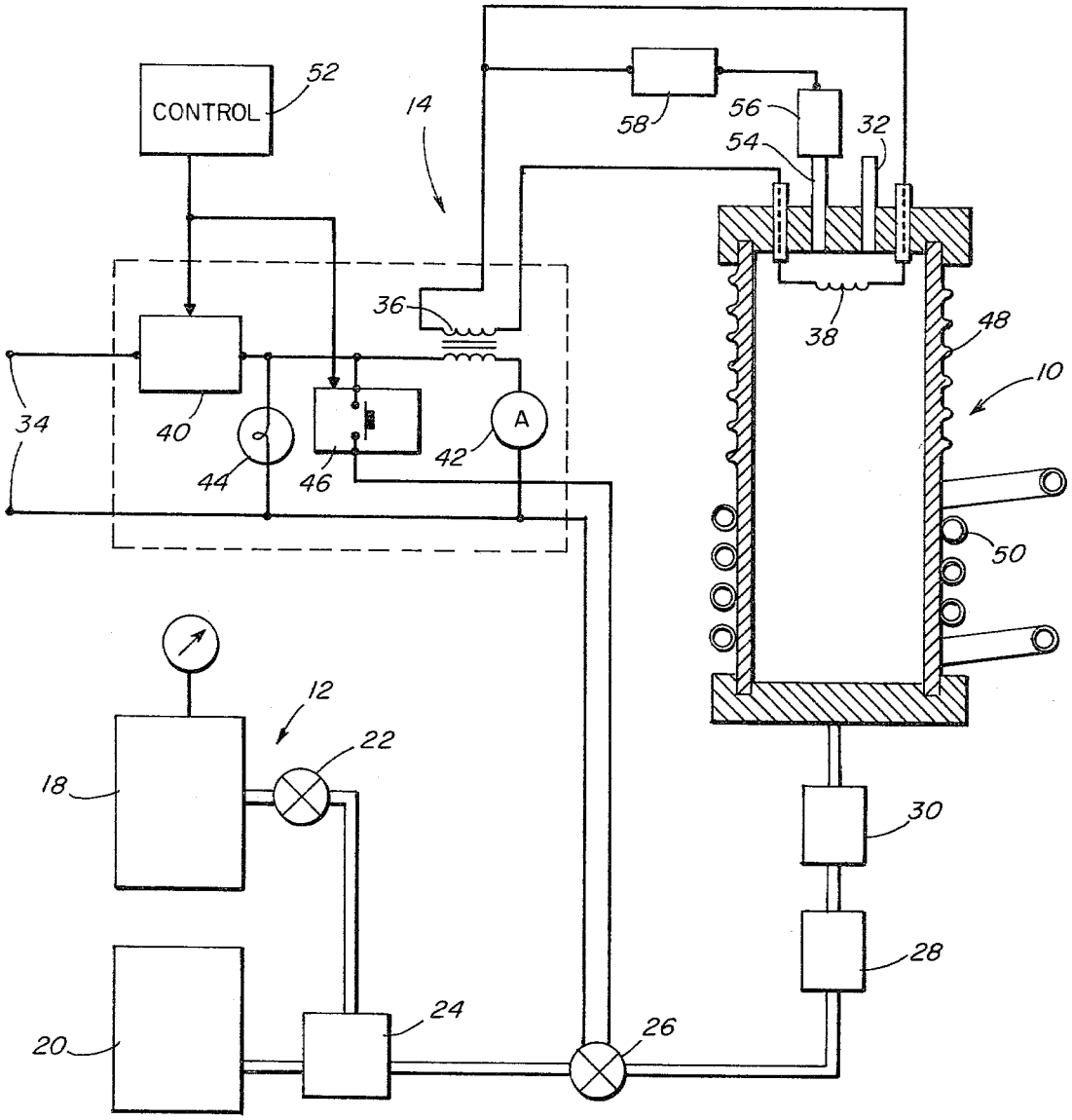
CONTROL
52
14
58
56
54
32
36
38
48
10
34
40
44
46
42
A
50
12
22
18
30
28
24
26
20

METHOD FOR GENERATING HEAT ENERGY BY INTERMITTENT SMOKE CHARGE COMBUSTION

This is a continuation of application Ser. No. 61,945, filed on July 30, 1979, now abandoned.

BACKGROUND OF THE INVENTION

1. Field of the Invention

The present invention relates to the generation of thermal energy from organic materials and, more particularly, to the generation of thermal energy by the combustion of a dispersion of a fine organic dust in air, i.e. a dust cloud, technically, a smoke.

2. The Prior Art

Present systems for generating thermal energy typically involve petroleum, natural gas, coal, and other fossil fuels; wood and like vegetation; and hydroelectric systems, nuclear reactor systems, and other capital intensive converters. All of these systems suffer from such problems as unduly low efficiency, excessive environmental polution, depletion of scarce resources, and excessive expense.

BRIEF DESCRIPTION OF THE INVENTION

The object of the present invention is to provide processes, particularly for heating air or water cheaply and efficiently, involving the intermittent explosion of successive charges of a smoke that is composed of a dispersion of fine particles of a carbonaceous material in air, the initial pressure of the charge being in excess of atmospheric and each period within which combustion of a charge occurs extending without repetition until substantially complete dissipation of the thermal energy through the combustion chamber wall has been completed. In this way, the combustion occurs at high temperature and pressure, at which high efficiency is assured and overall low temperature operation and construction materials are permitted.

Other objects of the present invention will in part be obvious and will in part appear hereandafter.

The invention accordingly comprises the devices and processes and their components and steps, together with their interrelationships, which are exemplified in the present disclosure, the scope of which will be indicated in the appended claims.

BRIEF DESCRIPTION OF THE DRAWING

For a fuller understanding of the nature and objects of the present invention, reference is made to the following detailed description, which is to be taken with the accompanying drawing, wherein the FIGURE is a schematic, partly in mechanical cross section and partly in electrical block diagram, of a device embodying the present invention.

DESCRIPTION OF THE DEVICE OF THE FIGURE

Generally, the device of the preferred embodiment illustrated herein is a thermal generator, particularly for heating air or water, comprising an internal combustion chamber 10. A flow system 12 for intermittently introducing explosive smoke charges into internal combustion chamber 10 and for scavenging the combustion products therfrom, and an ignition system 14 for intermittently causing successive explosions of the smoke charges at high temperature and pressure.

As shown, flow system 12 comprises a pressurized air supply chamber 18 and a dust storage chamber 20, which communicate as follows. Air supply 18 is fed via a control valve 22 through a venturi mixer 24, with which dust storage chamber 20 also communicates. Venturi mixer 24 is connected to internal combustion chamber 10 through a control valve 26, a quick connect valve 28, and a check valve 30. When control valve 26 opens, there is a burst of air from air supply 18 and venturi 24, in consequence of which fine particles from dust storage chamber 20 are mixed with the air flowing through venturi mixer 24. The smoke charge thus formed flows under pressure into internal combustion chamber 10. Following the explosion of the charge, which is to be described below, the combustion products flow from internal combustion chamber 10 through a vent pipe 32, the diameter of which is selected to provide a gradual reduction in pressure in the internal combustion chamber so that the heated combustion products therewithin are retained for a period of time during which most of its thermal energy is transferred to the wall of internal combustion chamber 10.

Ignition system 14 is energized by an electrical source 34 through a step-up transformer 36, by which an ignition coil 38 within internal combustion chamber 10 is energized. A switch 40 connects power supply 34 to the primary coil of a step-up transformer 36 in series with ammeter 42. Across ammeter 42 is a pilot lamp 44. A firing switch 46 connects the solenoid valve 26 across power supply 34 in order to permit a smoke charge from air supply 18 and dust supply 20 to pass through quick connect valve 28 and check valve 30 into internal combustion chamber 10. Within internal combustion chamber 10, the explosion of the smoke charge occurs and heat is generated at the walls of the internal combustion chamber. This heat is applied, in one form, to air flowing past fins 48 of the internal combustion chamber to a heating duct; and, in another form, into a coiled tube 50 through which water flowing is heated. It is to be understood that the heat generated also can be applied to a turbine or other prime mover.

THE PROCESS OF THE PRESENT INVENTION

In accordance with the present invention, the minimum concentration of dust in air is 25 ounces of dust per 1000 cubic feet of air at atmospheric pressure. Preferably the average particle size of the dust is within the range from 1 micron to 200 mesh. Preferably the minimum spark energy required for ignition is in excess of 15 millijoules. Typical materials of which the dust is composed are: agricultural by-products, such as corn cob meal, corn starch, cotton seed, guar seed, nut shells, onion, pea, alfalfa, potato, rice, soybean, sugar, tong, wheat, husks, and yeast; fossil hydrocarbons, such a coal and lignite; vegetation such as bark dust, cork, rubber, wood flour, and gums; and resins such as rosin, cellulose acetate, polyvinyl acetate, polyethylene, and polystyrene. The preferred dust composition is commonly known as biomass material, which is exemplified by agricultural byproducts. In practice, each of the series of explosions occurs and the heat it generates is dissipated before the next explosion occurs. In practice, a preferred cylinder is composed of cast aluminum or steel, being in cylindrical form with a diameter within the range of from 5 to 50 centimeters and a length within the range of from 100 to 1000 centimeters.

OPERATION

In operation, air supply 18 is provided at a pressure at least equal to atmospheric, and preferably in excess of atmospheric within the range of from 20 to 200 pounds per square inch. Actuation of main switch 40 occurs under the supervision of a control unit 52 as a result of which transformer 36 is energized. Immediately thereafter, firing switch 46 is actuated under the supervision of control unit 52. In consequence, solenoid valve 26 is opened and a charge of air from supply 18 and dust from supply 20 is mixed at venturi nozzle 24. This charge flows at a preselected pressure and concentration through quick connect valve 28 and check valve 30 into internal combustion chamber 10. When the pressure within internal combustion chamber 10 reaches a predetermined level, which is determined by a pressure guage 56 and a pressure switch 58, an explosion is initiated by ignition coil 38 and occurs within a time period during which the temperature and pressure rise to a maximum, transmitting heat to the wall of internal combustion chamber 10. This heat is completely dissipated by fluid either air or water, coming into contact or in proximity therewith. In the former case, the air is moved past fins 48 on chamber 10 for passage through the ducts of an air conditioning unit. In the latter case, the water is passed through spiral tubular coil 50 storage in a hot water tank. A second vent 54 feeds pressure gauge 56. Control 52 times the sequence of explosions in such a way that each explosion occurs after all of the heat from the previous explosion is dissipated into the heat exchange system.

Since certain changes may be made in the foregoing disclosure without departing from the scope of the invention herein, it is intended that all matter described in the foregoing specification or shown in the accompanying drawing be interpreted in an illustrative and not in a limiting sense.

What is claimed is:

1. An intermittent process of overall low temperature operation for producing and utilizing thermal energy, said process comprising:

(a) intermittently forming a smoke charge containing a mixture of an internal phase of a dispersion of fine solid particles and an external phase of air;

(b) said solid particles being composed of slowly igniting organic material selected from the class consisting of agricultural, fossil, vegetation, and resinous materials;

(c) said particles having an average diameter in the range of from 1 micron to 200 mesh;

(d) said smoke being of at least atmospheric pressure and having a minimum concentration of at least 25 ounces of said solid particles per 1000 cubic feet of air at atmospheric pressure;

(e) introducing said smoke charge, while maintained substantially at said atmospheric pressure, into a chamber;

(f) intermittently energizing said smoke charge, while initially under said substantially atmospheric pressure within said chamber, with an electric current having an energy of at least 15 millijoules in order to cause exploding of said smoke charge of limited duration and at high temperature, the intermittency of said energizing and of said exploding of said smoke charge being of sufficient lengths to enable substantially complete dissipation of heat generated by said exploding into a heat exchange system;

(g) powering an appliance with thermal energy generated by said exploding and transmitted through said heat exchange system;

(h) and scavenging the residue of said energizing and exploding from said chamber.

2. The process of claim 1 wherein said appliance is a thermal heater.

3. The process of claim 1 wherein said appliance is an air heater.

4. The process of claim 1 wherein said appliance is a water heater.

5. The process of claim 1 wherein said appliance is a prime mover.

6. The process of claim 1 wherein said solid particles are composed of a biomass material.

* * * * *